US008534369B2

(12) United States Patent
deBoer

(10) Patent No.: US 8,534,369 B2
(45) Date of Patent: Sep. 17, 2013

(54) DRILL STRING FLOW CONTROL VALVE AND METHODS OF USE

(75) Inventor: Luc deBoer, Richmond, TX (US)

(73) Assignee: Luc deBoer, Richmond, TX (US)

( * ) Notice: Subject to any disclaimer, the term of this patent is extended or adjusted under 35 U.S.C. 154(b) by 346 days.

(21) Appl. No.: 13/005,452

(22) Filed: Jan. 12, 2011

(65) Prior Publication Data

US 2011/0168410 A1 Jul. 14, 2011

Related U.S. Application Data

(60) Provisional application No. 61/294,402, filed on Jan. 12, 2010.

(51) Int. Cl.
*E21B 21/10* (2006.01)

(52) U.S. Cl.
USPC ..... 166/386; 166/321; 175/318

(58) Field of Classification Search
USPC ..... 166/386, 319, 321, 325; 175/318
See application file for complete search history.

(56) References Cited

U.S. PATENT DOCUMENTS

| | | | |
|---|---|---|---|
| 3,090,443 | A | 5/1963 | bostock |
| 3,973,587 | A | 8/1976 | Cochran |
| 6,216,799 | B1 | 4/2001 | Gonzalez |
| 6,263,981 | B1 | 7/2001 | Gonzalez |
| 6,276,455 | B1 | 8/2001 | Gonzalez |
| 6,325,159 | B1 | 12/2001 | Peterman et al. |
| 6,401,823 | B1 | 6/2002 | Gonzalez et al. |
| 8,066,079 | B2 * | 11/2011 | de Boer ..... 166/386 |
| 2002/0020558 | A1 | 2/2002 | Gonzalez |

FOREIGN PATENT DOCUMENTS

WO WO2007/124097 A2 11/2007

OTHER PUBLICATIONS

International Preliminary Report on Patentability and Written Opinion of the International Searching Authority, PCT/US2011/021022, date of Report Jul. 17, 2012, The International Bureau of WIPO, 19 pages.
Examination Report Under Section 18(3), dated Aug. 20, 2010, United Kingdom Intellectual Property Office, 3 pages.
International Search Report and Written Opinion of the International Searching Authority, Or the Declaration, PCT/US2010/032957, dated Oct. 22, 2010, European Patent Office, 16 pages.

* cited by examiner

*Primary Examiner* — William P Neuder
(74) *Attorney, Agent, or Firm* — Haynes and Boone, LLP

(57) ABSTRACT

A drill string flow control valve may comprise a valve housing, a valve sleeve axially movable within a valve housing from a closed position to an open position, a biasing mechanism biasing the valve sleeve into a closed position, and a plurality of pressure ports for allowing a differential pressure to be exerted on the valve sleeve. The valve may include a piston axially movable within the valve housing and bearing against the valve sleeve which piston may be used to initiate movement of the valve sleeve. The piston includes a flow passage therethrough in fluid communication with the interior of the valve sleeve and a ball valve disposed to control fluid flow through the piston. The valve may include a flow restriction in the flow path within the valve sleeve and disposed between pressure ports formed in the wall of the valve sleeve. Methods of use are also provided.

45 Claims, 9 Drawing Sheets

DRILL STRING FLOW CONTROL VALVE AND METHODS OF USE

CROSS REFERENCE TO RELATED APPLICATIONS

This application claims priority to U.S. provisional patent application No. 61/294,402, filed Jan. 12, 2010, the entire disclosure of which is incorporated herein by reference.

This application is related to U.S. provisional patent application No. 60/793,883, filed Apr. 21, 2006; U.S. utility patent application Ser. No. 11/788,660, filed Apr. 20, 2007, now U.S. Pat. No. 7,584,801; U.S. utility patent application Ser. No. 12/432,194, filed Apr. 29, 2009; and U.S. utility patent application Ser. No. 12/609,458, filed Oct. 30, 2009, the entire disclosures of which are incorporated herein by reference.

BACKGROUND

This disclosure generally relates to drill string flow control valves and more particularly, drill string flow control valves for prevention of u-tubing of fluid flow in drill strings and well drilling systems.

Managed Pressure Drilling (MPD) and Dual Gradient Drilling are oilfield drilling techniques that often utilize a higher density of drilling mud inside the drill string and a lower density return mud path on the outside of the drill string.

In Dual Gradient Drilling, an undesirable condition called "u-tubing" can result when the mud pumps for a drilling system are stopped. Mud pumps are commonly used to deliver drilling mud into the drill string and to extract return mud from the wellbore and a return riser (or risers). In a typical u-tubing scenario, fluid flow inside a drill string may continue to flow, even after the mud pumps have been powered down, until the pressure inside the drill string is balanced with the pressure outside the drill string, e.g., in the wellbore and/or a return riser (or risers). This problem is exacerbated in those situations where a heavier density fluid precedes a lighter density fluid in a drill string. In such a scenario, the heavier density fluid, by its own weight, can cause continued flow in the drill string even after the mud pumps have shut off. This u-tubing phenomenon, can result in undesirable well kicks, which can cause damage to a drilling system. For this reason, it is desirable that when mud pumps in a drilling system are turned off, the forward fluid flow be discontinued quickly.

Drill string flow control valves or flow stop valves are sometimes used to control flow in a downhole tubular, which may be, or form part of, a drill string. Some drill string flow control valves utilize the pressure differential between certain pressure ports positioned along the primary flow path of the valve to apply pressure to a valve sleeve within a valve housing to cause actuation of the valve sleeve. Movement of the valve sleeve, in turn, opens or closes the main drilling fluid flow ports within the valve. In prior art valves, at least two know drawbacks exist. First, to open the sleeve, significant forces maintaining the sleeve in a closed position must initially be overcome. Second, a rapid opening of the sleeve can cause a significant pressure drop in the valve. Thus, in some flow control valves, in order to overcome the significant forces maintaining the sleeve in a closed position, a solid piston is used to slowly initiate movement of the valve sleeve. As the valve sleeve of a prior art flow control valve is initially urged into the open position by the solid piston, flow through the main flow ports of the flow control valve begins. With respect to pressure drops within the valve, those skilled in the art will understand that because the main flow ports are relatively large, as they begin to open, just a small amount of movement of the valve sleeve can cause a drop in pressure as the ports open. For this reason, the solid piston described above is also desirable because it permits the valve sleeve to be opened slowly, thereby minimizing pressure drop. However, by slowly opening the main flow ports utilizing such a solid piston, the fluid flow passing through the ports is maintained at a high pressure, thereby causing potential washout of the flow ports, i.e., the high velocity of the fluid passing through the partially-open main flow ports will corrode or wash away the steel from which such flow control valves and main flow ports are typically fabricated.

SUMMARY

This disclosure generally relates to drill string flow control valves and more particularly, drill string flow control valves for prevention of u-tubing of fluid flow in drill strings and well drilling systems.

One example of a drill string flow control valve utilizes a piston with a flow passage therethrough to initiate movement of a valve sleeve within a flow control valve. The flow passage communicates fluid through the piston and into the interior of the valve sleeve, thereby bleeding off pressure from the fluid passing through the primary flow ports as the valve sleeve is initially opened. Thus, initially, drilling fluid flow through the valve sleeve is via the bore through the piston. As the valve sleeve continues to crack open, flow through the main flow ports begins. This permits a greater degree of control of flow through the main flow ports and minimizes the pressure drop associated with the prior art. In one preferred embodiment, part or all of the piston components are formed of a material, such as tungsten carbine, that is harder than, i.e., a higher Rockwall hardness factor, the material used to fabricate the rest of the valve (usually steel).

In one embodiment of the invention, a ball valve is disposed to control flow through the flow passage of the piston. Preferably, the ball valve comprises a ball and a ball seat disposed between a piston pressure port and a piston pressure surface. As pressure on the ball is increased, the ball engages the piston pressure surface and urges the piston against the valve sleeve, thereby initiating "opening" of the valve sleeve and main flow ports. At the same time, flow past the ball through the flow passage and into the interior of the valve sleeve reduces pressure at the primary sleeve flow ports. A biasing element may be used to urge the ball valve into the valve seat, i.e., the closed position. Those skilled in the art will appreciate that by altering the force of the biasing element on the ball, pressure at which movement of the ball initiates, and hence, operation of the overall flow control valve, can be adjusted as desired. Increasing pressure urges the ball out of the seat, and flow passes around the ball into the bore of the piston. Because the ball has a comparatively small surface area and there is little friction on the ball, a lower pressure can be used to open the ball valve.

The ball seat can simply be a ring with a bore therethrough and edges chamfered or otherwise shaped to mate with the profile of the ball. A snap ring may be used to secure the ball seat in place within the port used to direct a portion of the flow through the piston.

In one embodiment, a plug body with an axial bore has the piston axially mounted in the plug body. The ball seat mounts in the axial bore of the plug. The axial bore forms the flow port to the piston.

In one embodiment, a filter type lockdown nut is used to secure the ball seat in place within the port. The lockdown nut has a bore therethrough which opens to the end of the nut. A first end of the nut is provided with a plurality of apertures to allow flow into the bore.

In any event, the arrangement of the invention permits a slow, controlled increase in the flow rate through the small piston to create sufficient pressure differential to begin to open the main flow ports of the valve sleeve.

In one example, a drill string flow control valve comprises a valve housing characterized by a wall defining a valve interior, wherein the valve housing has an internal housing flow path formed therein with a housing outlet flow port disposed along said internal housing flow path; a valve sleeve disposed at least partially in the interior of the valve housing, the valve sleeve characterized by a first end and a second end and a wall defining a sleeve interior, a first sleeve flow port defined within the valve sleeve wall, and a second sleeve flow port defined within the valve sleeve wall adjacent said first end, wherein the valve sleeve is axially movable within the valve housing between a closed position and an open position, such that the valve sleeve wall substantially impedes fluid flow from the housing outlet flow port to the first sleeve flow port when the valve sleeve is in the closed position and wherein the first sleeve flow port and the housing outlet flow port are in substantial alignment when in the open position; wherein the valve sleeve has an upper pressure surface defined thereon so as to provide a first surface area upon which a first fluid pressure from the internal housing flow path may act to provide a downward force on the valve sleeve and wherein the valve sleeve has a lower pressure surface defined thereon so as to provide a second surface area upon which a second fluid pressure may act to provide an upward force on the valve sleeve; a spring wherein the spring biases the valve sleeve to the closed position by exertion of a biasing force on the valve sleeve; an upper pressure port in fluid communication with said internal housing flow path, said upper pressure port disposed to allow the first fluid pressure to act upon the upper pressure surface; a lower pressure port that allows the second fluid pressure to act upon the lower pressure surface; a piston having a first end and a second end and axially movable within the valve housing, said piston further characterized by a flow passage therethrough, wherein the second end of the piston is adjacent one end of the valve sleeve to permit fluid communication between said piston flow passage and said second sleeve flow port and wherein the first end of the piston has a piston pressure surface characterized by a piston surface area; and a piston pressure port in fluid communication with the internal housing flow path that allows a fluid pressure internal to the valve to act upon the piston pressure surface, said piston pressure port in fluid communication with said piston flow passage The drill string flow control valve may include a ball and a ball seat disposed between the piston pressure port and the piston pressure surface. A biasing element, such as a spring, may be disposed to urge the ball into contact with the ball seat. Another example of a drill string flow control valve comprises a valve housing, wherein the valve housing is characterized by a cylindrical wall extending from a first end to a second end and defining a valve interior, wherein the valve housing has an internal housing flow path channel formed between said first and second ends with a housing outlet flow port disposed along said flow path channel; a valve sleeve disposed at least partially in the valve housing, the valve sleeve characterized by a valve sleeve wall defining a valve sleeve interior, said valve sleeve having a first sleeve flow port defined within said wall and a second sleeve flow port defined within said wall, wherein the valve sleeve is axially movable within the valve housing between a closed position and an open position, such that fluid flow between said housing outlet flow port and said first sleeve flow port is substantially impeded when the valve sleeve is in the closed position and wherein the first sleeve flow port and the housing outlet flow port are substantially aligned when in the open position; wherein the valve sleeve has a first pressure surface defined thereon so as to provide a first surface area upon which a first fluid pressure from the housing flow path channel may act to provide a downward force on the valve sleeve, and wherein the valve sleeve has a second pressure surface defined thereon so as to provide a second surface area upon which a second fluid pressure may act to provide an upward force on the valve sleeve; a biasing mechanism wherein the biasing mechanism biases the valve sleeve to the closed position; a first pressure channel that allows the first fluid pressure to act upon the first pressure surface; a second pressure channel that allows the second fluid pressure to act upon the second pressure surface; an elongated piston having a first end, an internal bore and a second end open to said internal bore, said piston axially movable within the valve housing, wherein said second open end is in fluid communication with said second sleeve flow port; and a piston pressure in fluid communication with the internal housing flow path, said piston pressure port in fluid communication with said internal bore of said piston.

An example of a method for controlling flow in a downhole tubular comprises restricting flow through the downhole tubular by closing a flow stop valve when a difference between a first fluid pressure outside the downhole tubular and a second fluid pressure along a primary flow path within inside the downhole tubular at the flow stop valve is below a threshold value; and permitting flow through along the primary flow path of the downhole tubular by opening the flow stop valve when a difference between the first fluid pressure outside the downhole tubular and the second fluid pressure inside the downhole tubular at the flow stop valve is above a threshold value, wherein said flow stop valve is opened by: introducing drilling fluid into the valve to induce a pressure applied to the pressure surface of a piston, thereby causing said piston to urge a valve sleeve from a closed position; directing a portion of said drilling fluid through said piston and into the interior of said valve sleeve to establish initial flow through said valve; directing another portion of said drilling fluid against said valve sleeve to apply a fluid pressure on the valve sleeve; and increasing the fluid pressure upon the valve sleeve so as to cause the valve sleeve to axially move against the biasing direction of a spring, thereby increasing fluid flow through said valve sleeve.

Another example of a method for controlling flow in a downhole tubular comprises providing a valve housing, wherein the valve housing is characterized by a tubular wall extending from a first end to a second end and defining a valve interior, wherein the valve housing has an internal housing flow path formed between said first and second ends with a housing outlet flow port disposed along said internal flow path; providing a valve sleeve disposed at least partially in the valve housing, the valve sleeve having at least two pressure surfaces and axially movable within the valve housing between a closed position and an open position, providing a piston having a flow passage therethrough within the valve housing and bearing against the valve sleeve; biasing the valve sleeve under a biasing force in a first direction against the piston so as to close the valve; introducing drilling fluid into the valve housing to induce a first fluid pressure therein; applying said first fluid pressure to the piston pressure surface, thereby causing said piston to urge the valve sleeve in a second direction opposite the first direction; directing a portion of the drilling fluid to flow through said piston flow passage and into the interior of said valve sleeve to initiate flow; applying a fluid pressure from within the valve housing to a first surface of the valve sleeve to generate a first force to urge the valve sleeve in the second direction; applying a second fluid pressure derived from downstream of said first fluid pressure to a second surface of the valve sleeve to generate a second force to urge the valve sleeve in the first direction; maintaining a drilling fluid flow through the valve sleeve so that the first force is greater than the biasing spring force plus the second force; and decreasing the fluid flow through the valve sleeve so as to allow the biasing force to shift the valve sleeve in the first direction, thereby urging the valve into a closed position.

An example of a drill string flow control valve system comprises a valve housing, wherein the valve housing is characterized by a tubular wall extending from a first end to a second end and defining a valve interior, wherein the valve housing has an internal housing flow path formed between said first and second ends with a housing outlet flow port disposed along said internal flow path; a valve sleeve disposed at least partially in the valve housing, the valve sleeve having a first end and a second end and characterized by a valve sleeve wall extending between said first and second ends to define a valve sleeve interior, said valve sleeve having a first flow port disposed in said valve sleeve wall and a second flow port at said first end, wherein the valve sleeve is axially movable within the valve housing between a closed position and an open position, such that fluid flow between said housing outlet flow port and said first flow port is substantially impeded when the valve sleeve is in the closed position and wherein the first flow port and the housing outlet flow port are substantially aligned when in the open position; wherein the valve sleeve has an upper pressure surface defined thereon so as to provide a first surface area upon which a first fluid pressure from the internal housing flow path may act to provide a downward force on the valve sleeve, and wherein the valve sleeve has a lower pressure surface defined thereon so as to provide a second surface area upon which a second fluid pressure may act to provide an upward force on the valve sleeve; a spring, wherein the spring biases the valve sleeve to the closed position by exertion of a biasing force on the valve sleeve; an upper pressure port disposed internally to said valve housing between said sleeve flow port and the second end of said valve sleeve, said upper pressure port in fluid communication with the upper pressure surface, said upper pressure port disposed to allow the first fluid pressure to act upon the upper pressure surface, wherein the first fluid pressure is measured from adjacent the first end of the valve housing; a lower pressure port disposed internally to said valve housing so as to allow the second fluid pressure to act upon the lower pressure surface, wherein the second fluid pressure is measured from adjacent the second end of the valve housing; an upper pressure port that allows the first fluid pressure to act upon the first pressure surface; a lower pressure port that allows the second fluid pressure to act upon the second pressure surface; an elongated piston having a first end, an internal bore and a second end open to said internal bore, said piston axially movable within the valve housing, wherein the second end of the piston is adjacent an end of the valve sleeve and in fluid communication with the second flow port of said valve sleeve, and wherein the first end of the piston has a piston pressure surface characterized by a piston surface area; and a piston pressure port in fluid communication with said internal housing flow path that allows a fluid pressure internal to the valve to act upon the piston pressure surface, said piston pressure port in fluid communication with said piston internal bore, wherein the valve sleeve further comprises a flow restriction in the valve sleeve interior, wherein said lower pressure port is disposed in the wall of the valve sleeve below the flow restriction and the upper pressure port is disposed in the wall of the valve sleeve above the flow restriction.

Another example of a drill string flow control valve system comprises a valve housing formed of a tubular member extending from a first end to a second end and characterized by an external surface, said tubular member having a first flow path internally disposed therein; a valve sleeve slidingly mounted in the valve housing, said valve sleeve having a first end, a first flow port, a second flow port, a valve sleeve interior and a second end; a piston having a first end, an internal piston bore and a second open end in fluid communication with said piston bore, said piston slidingly mounted in the valve housing between said first end of the tubular member and said valve sleeve, wherein the second end of the piston is disposed to urge the valve sleeve axially relative to the valve housing, wherein said second open end of said piston is in fluid communication with the second flow port of said valve sleeve; a piston pressure port in fluid communication with said first internal housing flow path, said piston pressure port also in fluid communication with the piston bore; a ball and ball seat disposed along said piston pressure port; a first biasing mechanism disposed to urge said piston against said ball and to urge said ball into contact with said ball seat; a second biasing mechanism for biasing the valve sleeve against the piston; a first pressure port in the valve sleeve, said first pressure port in fluid communication with said internally disposed first flow path, said first pressure port in fluid communication with a first surface of the sleeve to provide a pressure acting on the first surface of the sleeve; and a second pressure port in fluid communication with a second surface of the sleeve to provide a second fluid pressure acting on the second surface of the sleeve, said second fluid pressure derived from adjacent the second end of said valve housing.

An example of a drill string flow stop valve comprises a tubular housing having an external surface and a first flow path internally disposed therein and an internal flow port disposed along said flow path; a hollow tubular section slidingly mounted in the valve housing and movable between a first position and a second position thereby establishing a second flow path in the interior of the hollow tubular section, wherein the hollow tubular section substantially impedes fluid flow through the internal flow port to an interior of the hollow tubular section when the valve sleeve is in the first position and wherein fluid flow through the internal flow port to the interior of the hollow tubular section is permitted when the valve sleeve is in the second position; a biasing mechanism for biasing the hollow tubular section toward the first position; a first vent in fluid communication with the internally disposed first flow path, said first vent in fluid communication with a first pressure chamber; a second vent in fluid communication with a second pressure chamber which is separate from the first pressure chamber, said second vent in fluid communication with the second flow path; an elongated piston having a first end, an internal bore and a second end open to said internal bore, wherein said second open end is in fluid communication with the interior of said hollow tubular section; and a third vent in fluid communication with the internally disposed first flow path, said third vent in fluid communication with said internal bore of said elongated piston.

In another improvement over the prior art, it has been found that flow control valves that utilize a jet or flow restriction disposed within the valve sleeve can position the first pressure channel (or upper pressure port or first pressure port) in the wall of the valve sleeve above the flow restriction as opposed to locating the first pressure channel outside the valve sleeve. A second pressure channel (or lower pressure port or second pressure port) is located downstream of the flow restriction. Although not necessary for use with embodiments of a flow control valve utilizing a small piston as described above, this arrangement is particularly beneficial in embodiments of a flow control valve utilizing a small piston since the initial flow through the small piston establishes fluid flow through the valve sleeve and restriction. The fluid has a first pressure above the restriction and a second pressure below the restriction. This pressure difference can be utilized to continue to open the valve as described in the prior art. However, the need for separate or complicated flow channels formed outside the valve sleeve, such as in the mandrel of the flow control valve, is eliminated. For fabrication purposes and simplification of manufacture and costs thereof, it is much easier to create flow ports that simply extend through the wall of the valve sleeve.

An example of a drill string flow control valve system comprises a valve housing, wherein the valve housing is characterized by a tubular wall extending from a first end to a second end and defining a valve interior, wherein the valve housing has an internal housing flow path formed between said first and second ends with a housing outlet flow port disposed along said internal flow path; a valve sleeve disposed at least partially in the valve housing, the valve sleeve having a first end and a second end and characterized by a valve sleeve wall extending between said first and second ends to define a valve sleeve interior, said valve sleeve having a first flow port disposed in said valve sleeve wall and a second flow port at said first end, wherein the valve sleeve is axially movable within the valve housing between a closed position and an open position, such that fluid flow between said housing outlet flow port and said first flow port is substantially impeded when the valve sleeve is in the closed position and wherein the first flow port and the housing outlet flow port are substantially aligned when in the open position; wherein the valve sleeve has an upper pressure surface defined thereon so as to provide a first surface area upon which a first fluid pressure from the internal housing flow path may act to provide a downward force on the valve sleeve, and wherein the valve sleeve has a lower pressure surface defined thereon so as to provide a second surface area upon which a second fluid pressure may act to provide an upward force on the valve sleeve; a spring, wherein the spring biases the valve sleeve to the closed position by exertion of a biasing force on the valve sleeve; an upper pressure port disposed internally to said valve housing between said sleeve flow port and the second end of said valve sleeve, said upper pressure port in fluid communication with the upper pressure surface, said upper pressure port disposed to allow the first fluid pressure to act upon the upper pressure surface, wherein the first fluid pressure is measured from adjacent the first end of the valve housing; a lower pressure port disposed internally to said valve housing so as to allow the second fluid pressure to act upon the lower pressure surface, wherein the second fluid pressure is measured from adjacent the second end of the valve housing; an upper pressure port that allows the first fluid pressure to act upon the first pressure surface; a lower pressure port that allows the second fluid pressure to act upon the second pressure surface; an elongated piston having a first end, an internal bore and a second end open to said internal bore, said piston axially movable within the valve housing, wherein the second end of the piston is adjacent an end of the valve sleeve and in fluid communication with the second flow port of said valve sleeve, and wherein the first end of the piston has a piston pressure surface characterized by a piston surface area; and a piston pressure port in fluid communication with said internal housing flow path that allows a fluid pressure internal to the valve to act upon the piston pressure surface, said piston pressure port in fluid communication with said piston internal bore, wherein the valve sleeve further comprises a flow restriction in the valve sleeve interior, wherein said lower pressure port is disposed in the wall of the valve sleeve below the flow restriction and the upper pressure port is disposed in the wall of the valve sleeve above the flow restriction. The system may further have an elongated piston having a first end, an internal bore and a second end open to said internal bore, the piston axially movable within the valve housing, wherein the second end of the piston is adjacent an end of the valve sleeve and in fluid communication with the second flow port of said valve sleeve, and wherein the first end of the piston has a piston pressure surface characterized by a piston surface area; and a piston pressure port in fluid communication with said internal housing flow path that allows a fluid pressure internal to the valve to act upon the piston pressure surface. In this embodiment, the piston pressure port is in fluid communication with the piston internal bore.

In another embodiment, the flow restriction or jet can be interchangeable so as to permit the flow rate and the desired pressure drop across the flow restriction to be adjusted (and thereby adjust operating pressures for the valve). For example, a restriction may be formed by providing a ring with a bore through the ring that narrows from one end to the other end of the ring. The dimensions of the bore can be altered to adjust the pressure drops. The ring may be interchangeable with others and secured in place within the annulus of the valve sleeve by a snap ring or similar fastener. As described above, while most beneficial in flow stop valves utilizing a small piston that engages a valve sleeve, the arrangement of a flow restriction in a valve sleeve bounded by an upper and lower pressure port would also be beneficial in flow stop valves without such a piston.

The features and advantages of this disclosure will be apparent to those skilled in the art. While numerous changes may be made by those skilled in the art, such changes are within the spirit of this disclosure.

BRIEF DESCRIPTION OF THE DRAWINGS

A more complete understanding of this disclosure and advantages thereof may be acquired by referring to the following description taken in conjunction with the accompanying figures, wherein.

Figure 1:
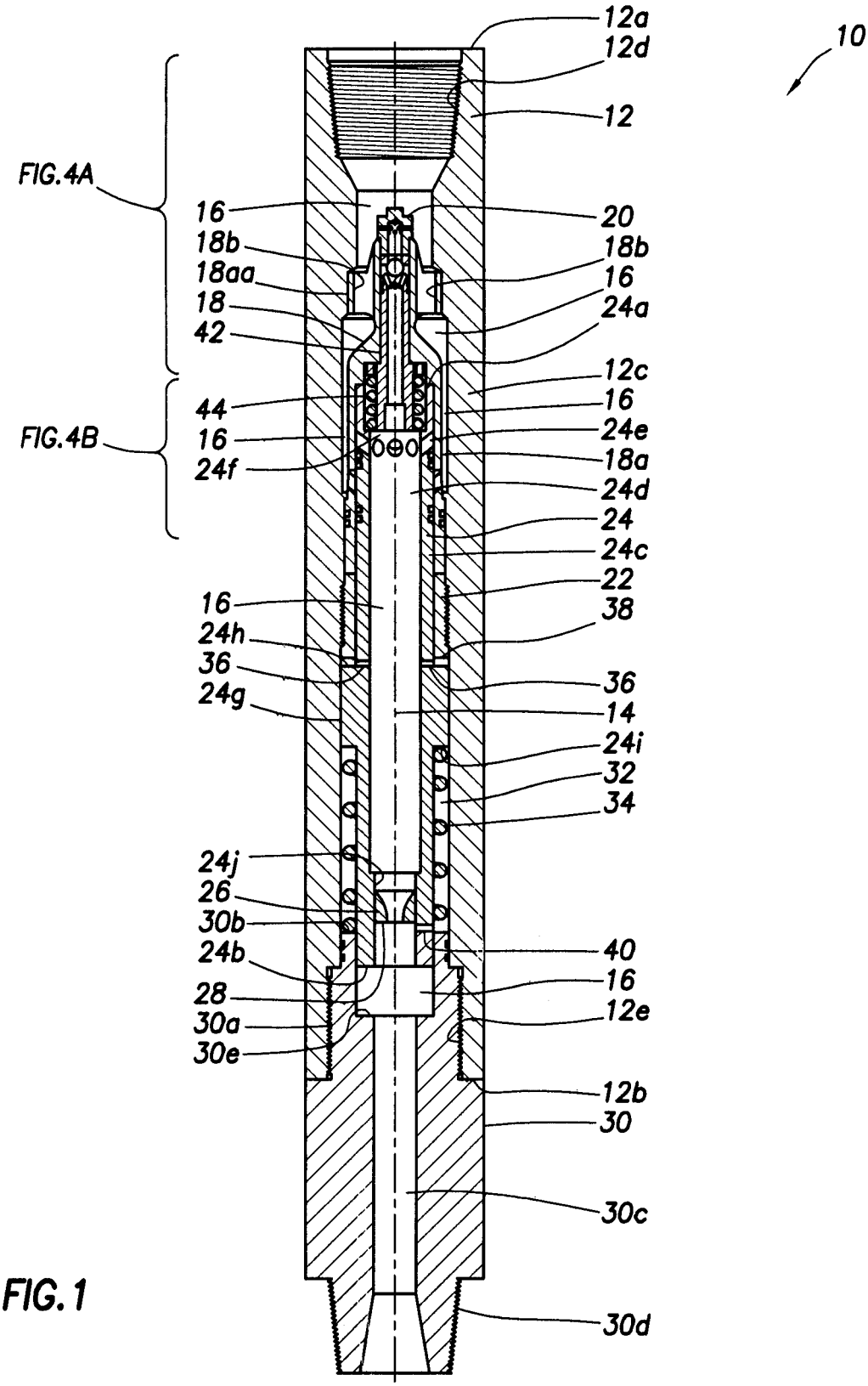
FIG. 1 illustrates a cross-sectional view of a drill string flow control valve according to an exemplary embodiment, the drill string flow control valve being in a closed position and including a valve housing, a plug and a lockdown nut.

While this disclosure is susceptible to various modifications and alternative forms, specific exemplary embodiments thereof have been shown by way of example in the drawings and are herein described in detail. It should be understood, however, that the description herein of specific embodiments is not intended to limit the disclosure to the particular forms disclosed, but on the contrary, the intention is to cover all modifications, equivalents, and alternatives falling within the spirit and scope of the disclosure as defined by the appended claims.

DETAILED DESCRIPTION

This disclosure generally relates to drill string flow control valves and more particularly, drill string flow control valves for prevention of u-tubing of fluid flow in drill strings and well drilling systems.

Drill string flow control valves are provided herein that, among other functions, can be used to reduce and/or prevent u-tubing effects in drill strings.

To facilitate a better understanding of this disclosure, the following examples of certain embodiments are given. In no way should the following examples be read to limit, or define, the scope of the disclosure.

For ease of reference, the terms "upper," "lower," "upward," and "downward" are used herein for convenience only to identify various components and refer to the spatial relationship of certain components, regardless of the actual orientation of the flow control valve. The term "axial" refers to a direction substantially parallel to the drill string in proximity to a drill string flow control valve.

Figure 2:
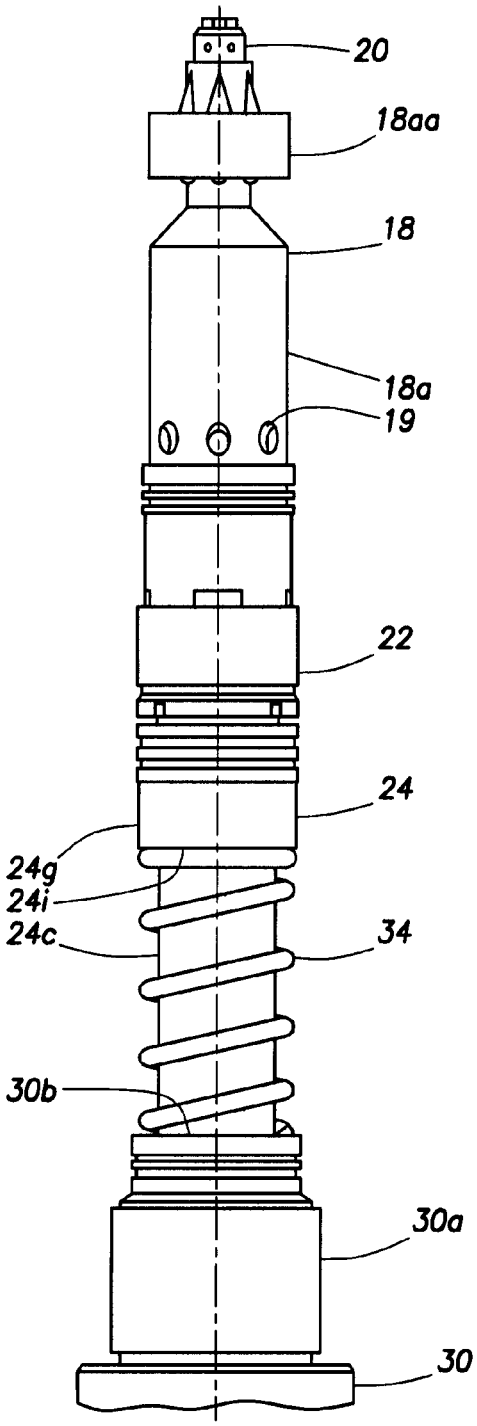
FIG. 2 illustrates an elevational view of a portion of the drill string flow control valve of FIG. 1, according to an exemplary embodiment, the portion omitting the valve housing of FIG. 1.
Figure 3:
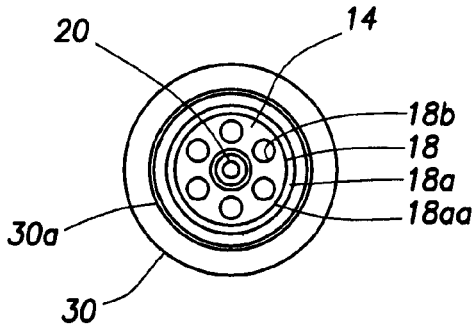
FIG. 3 illustrates a top plan view of the portion of the drill string flow control valve of FIG. 2, according to an exemplary embodiment.

In an exemplary embodiment, as illustrated in FIGS. 1, 2 and 3, a drill string flow control valve is generally referred to by the reference numeral 10 and includes a mandrel or valve housing 12 having an upper end 12*a* and a lower end 12*b*, and is characterized by a housing wall 12*c* extending therebetween so as to define an interior 14 of the valve 10 extending from the upper end 12*a* to the lower end 12*b*. The valve housing 12 has an internal housing flow path 16 formed therein for the flow of drilling fluids and the like through the valve 10. The valve housing 12 further includes an internal threaded connection 12*d* proximate the upper end 12*a*, and an internal threaded connection 12*e* proximate the lower end 12*b*. It will be appreciated that flow path 16 includes a primary portion, which is the path along which the largest volume of fluid flows when valve 10 is fully open.

A plug 18 having a varying-diameter tubular wall 18*a* is disposed within the interior 14. A plurality of axially-extending flow bores 18*b* are defined in a flanged portion 18*aa* of the tubular wall 18*a*. A plurality of housing outlet flow ports 19 is defined in the tubular wall 18*a*. Although the valve housing 12 and the plug 18 are shown here as two or more components, in several exemplary embodiments, these components may be formed as one integral piece such that the plug 18 is simply a part of the valve housing 12. Moreover, the plug 18 may be considered to be part of the valve housing 12, regardless of whether the valve housing 12 and the plug 18 are formed as one integral piece or are two or more components. In this particular embodiment, a plug is preferred because it obviates the need to bore internal flow channels in the valve housing. Rather, internal flow channels, such as internal housing flow path 16, can be defined between or by the engagement of plug 18 and valve housing 12, such as by an annulus that may be defined when plug 18 is engaged with valve housing 12. In any event, the axially-extending flow bores 18*b* and the housing outlet flow ports 19 form part of the flow path 16. A lockdown nut 20 is connected to the upper end portion of the plug 18. In an exemplary embodiment, the lockdown nut 20 is a filter-type lockdown nut. A lock nut 22 is engaged with the lower end portion of the plug 18.

A valve sleeve 24 is disposed within the interior 14. The valve sleeve 24 is axially slidable or movable within the valve housing 12. In an exemplary embodiment, the valve sleeve 24 may be partially disposed within a portion of the plug 18, as shown in FIG. 1. The valve sleeve 24 is characterized by an upper end 24*a* and a lower end 24*b*, and a valve sleeve wall 24*c* extending therebetween and defining a sleeve interior 24*d*. The sleeve interior 24*d* forms part of the flow path 16. A plurality of sleeve flow ports 24*e* is defined in the valve sleeve wall 24*c*. The sleeve flow ports 24*e* form part of the flow path 16. In an exemplary embodiment, the sleeve flow ports 24*e* are substantially radially formed in the valve sleeve wall 24*c*. A sleeve flow port 24*f* is defined in the valve sleeve wall 24*c* adjacent the upper end 24*a*. In an exemplary embodiment, the sleeve flow port 24*f* is substantially axially formed in the valve sleeve wall 24*c*. A flange 24*g* may be formed on valve sleeve 24. The flange 24*g* defines thereon an first pressure surface 24*h* so as to provide a surface area upon which a fluid pressure from the flow path 16 may act to provide a downward force on the valve sleeve 24, under conditions to be described below. The flange 24*g* also defines thereon a second pressure surface 24*i* so as to provide another surface area upon which a fluid pressure may act to provide an upward force on the valve sleeve 24, under conditions to be described below. An annular portion 24*j* extends radially inwardly from the valve sleeve wall 24*c*. While flange 24*g* is described as a single component, those skilled in the art will appreciate that separate projections or surfaces extending from sleeve 24 may be utilized so long as they provide the pressure surfaces as described herein. One or more sealing elements 24*l*, such as o-rings and o-ring grooves, may be positioned along the length of sleeve 24 so as to form a seal between sleeve 24 and valve housing 12 (and/or plug 18, as the case may be).

A jet or flow restriction 26 may be disposed within the sleeve interior 24*d*. Although flow restriction 26 may be located anywhere along the interior 24*d* of sleeve 24, in a preferred embodiment, flow restriction 26 is positioned adjacent the lower end of the annular portion 24*j* of the valve sleeve 24. A snap ring 28 is disposed within the sleeve interior 24*d* and is engaged with the valve sleeve wall 24*c*. The flow restriction 26 is axially positioned between the annular portion 24*j* and the snap ring 28. In an exemplary embodiment, the flow restriction 26 may be formed by providing a ring with a bore therethrough that narrows from one end to the other end of the ring. In several exemplary embodiments, the flow restriction 26 may be interchangeable with other jets or flow restrictions and secured in place within the sleeve interior 24*d* by the snap ring 28, other snap ring(s), or similar fastener(s).

An external threaded connection 30*a* at one end of a sub 30 is engaged with the internal threaded connection 12*e* of the valve housing 12, thereby connecting the sub 30 to the valve housing 12. The sub 30 defines an upper end surface 30*b*, and an interior 30*c*, which, in several exemplary embodiments, forms part of the flow path 16. The sub 30 further includes an external threaded connection 30*d* at the other end thereof, and an internal shoulder 30*e*.

A variable-volume pressure chamber 32 is defined adjacent pressure surface 24*i*. In one embodiment, pressure chamber 32 is an annular region formed between the inside surface of the valve housing wall 12*c* of the valve housing 12, and the outside surface of the valve sleeve wall 24*c* of the valve sleeve 24. The annular region 32 is axially defined between the lower pressure surface 24*i* of the valve sleeve 24, and a location at least proximate the upper end surface 30*b* of the sub 30. A coil sleeve spring 34 is disposed within the annular region 32 so that the valve sleeve wall 24*c* extends through the sleeve spring 34 and the coils of the sleeve spring 34 extend circumferentially about the valve sleeve wall 24*c*. The valve sleeve 24 is biased upwards by the sleeve spring 24. In several exemplary embodiments, instead of, or in addition to, the coil sleeve spring 34, one or more other biasing mechanisms may be disposed in the annular region 32 to thereby bias the valve sleeve 24 upwards.

One or more pressure fluid ports or vents 36 are in fluid communication the flow path 16. The pressure fluid ports 36 are preferably bled off from an upper portion of flow path 16. In an exemplary embodiment, as shown in FIG. 1, the upper pressure fluid ports 36 are formed in the valve sleeve wall 24*c*. Pressure fluid ports 36 are positioned above flow restriction 26 in those embodiments in which a flow restriction 26 is provided. A variable-volume pressure chamber 38 is defined adjacent pressure surface 24*h*. In one embodiment, pressure chamber 38 is an annular region defined between the inside surface of the valve housing wall 12*c* of the valve housing 12, and the outside surface of the valve sleeve wall 24*c* of the valve sleeve 24. The annular region 38 is axially defined between the lower end of the lock nut 22 and the upper pressure surface 24*h* of the valve sleeve 24. Via the upper pressure fluid ports 36, the annular region 38 is in fluid communication with the sleeve interior 24*d* and thus with the flow path 16.

At least one lower pressure fluid port or vent 40 is in fluid communication with the sleeve interior 24*d* and thus with the flow path 16. In an exemplary embodiment, the lower pressure fluid port 40 is formed in the valve sleeve wall 24*c*. Via the lower pressure fluid port 40, the annular region 32 is in fluid communication with the sleeve interior 24*d* and thus with the flow path 16. In several exemplary embodiment, instead of, or in addition to, the lower pressure fluid port 40, one or more other lower pressure fluid ports identical to the lower pressure fluid port 40 may be formed in the valve sleeve wall 24*c* below the lower pressure surface 24*i* of the valve sleeve 24 at different axial positions therealong.

A piston 42 is disposed within the plug 18 and thus within the interior 14. The piston 42 is axially slidable or movable within the plug 18 and thus within the valve housing 12. In an exemplary embodiment, as show in FIG. 1, at least a portion of the piston 42 engages the valve sleeve 24. The valve 10 further includes a piston spring 44, which is adapted to engage each of the piston 42 and the valve sleeve 24. The piston 42 and the piston spring 44 will be described in further detail below.

Figure 4A:
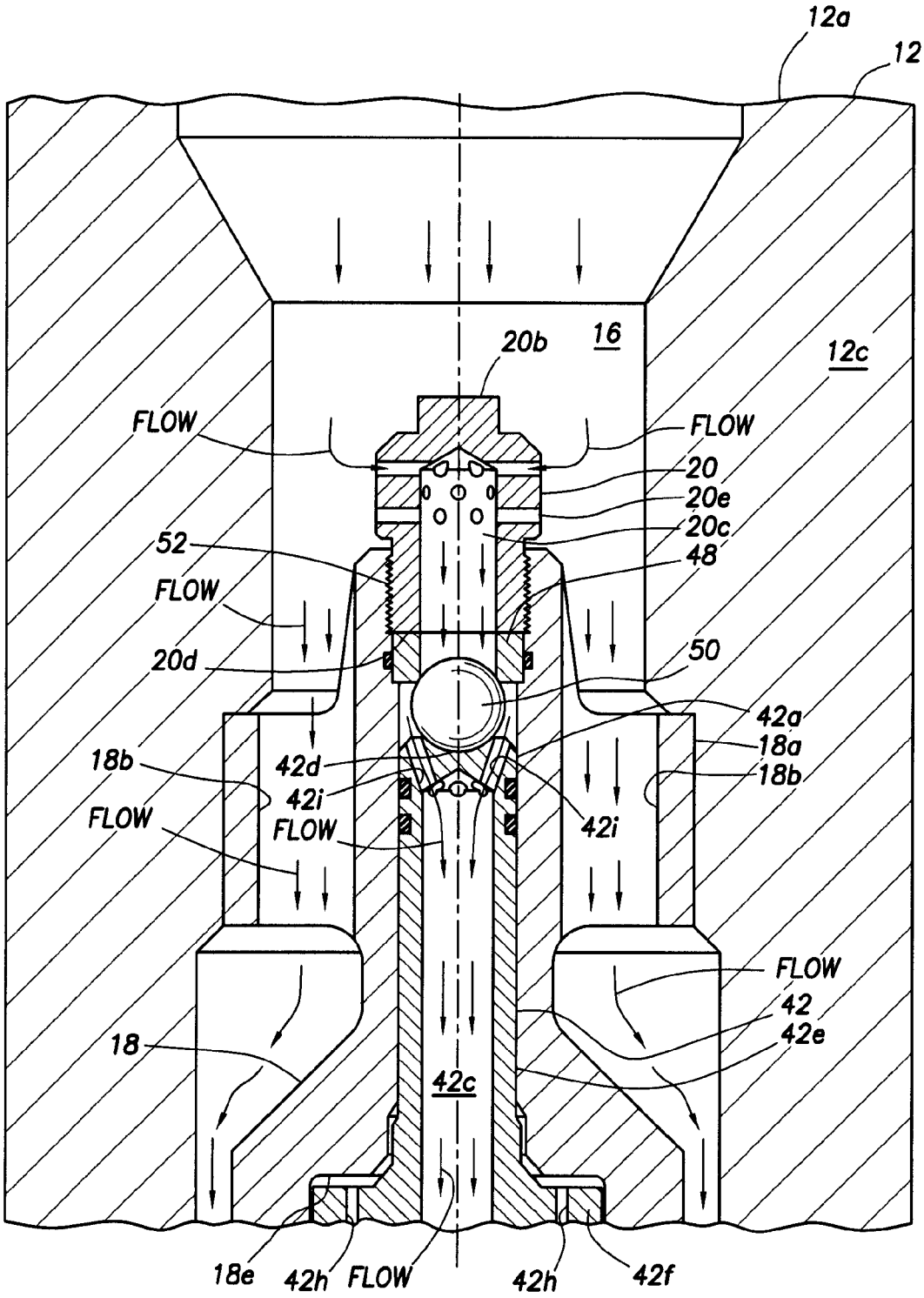
FIG. 4A illustrates an enlarged view of a portion of FIG. 1, according to an exemplary embodiment.
Figure 4B:
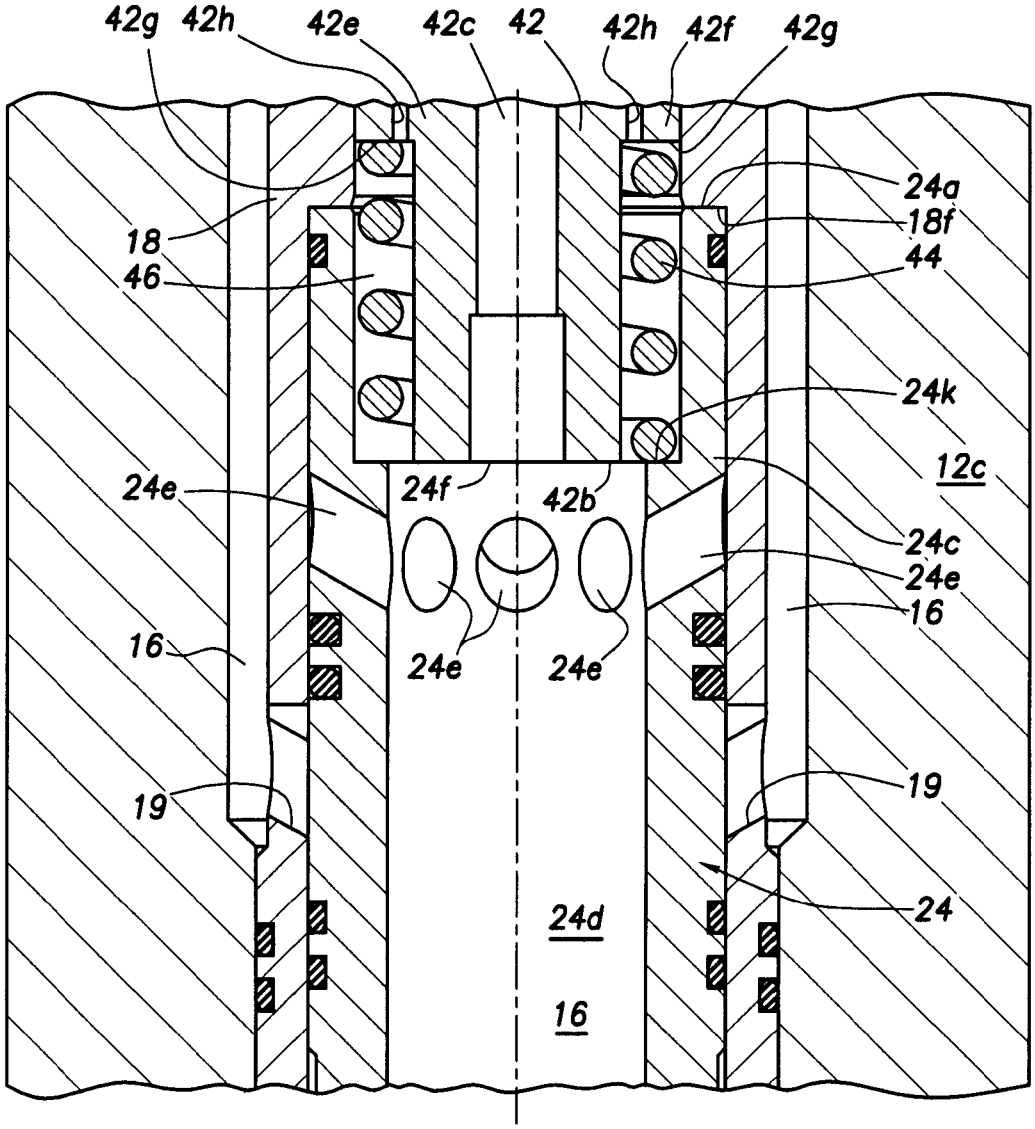
FIG. 4B illustrates an enlarged view of another portion of FIG. 1, according to an exemplary embodiment.

In an exemplary embodiment, as illustrated in FIGS. 4A and 4B with continuing reference to FIGS. 1, 2 and 3, the piston 42 has an upper end 42*a* and a lower end 42*b*, and is characterized by a piston flow passage 42*c* therethrough. The lower end 42*b* of the piston 42 is adjacent the upper end 24*a* of the valve sleeve 24 to permit fluid communication between the flow passage 42*c* and the sleeve flow port 24*f*. The upper end 42*a* of the piston 42 has a piston pressure surface 42*d* characterized by a piston surface area. In an exemplary embodiment, the piston pressure surface 42*d* is a concave surface, as shown in FIG. 4A. In an exemplary embodiment, the piston surface area of the piston pressure surface 42*d* is smaller than the surface area of the upper pressure surface 24*h* of the valve sleeve 24. The piston 42 includes an elongated, cylindrical body 42*e* through which the flow passage 42*c* is formed. The cylindrical body 42*e* extends between the upper end 42*a* and the lower end 42*b*. A flange 42*f* extends radially outwardly from, and thus circumferentially about, the cylindrical body 42*e*. A lower surface 42*g* is defined by the flange 42*f*. Axially-extending bores 42*h* are formed through the flange 42*f*. The piston 42 is axially slidable or movable within the plug 18 and thus within the valve housing 12. Flow ports 42*i* are formed in upper end 42*a* of the piston 42 to communicate with flow passage 42*c*. One or more sealing elements 42*k*, such as o-rings and o-ring grooves, may be positioned along the length of piston 42 so as to form a seal between piston 42 and plug 18.

As shown in FIG. 4B, an annular region 46 is defined around the outside surface of the cylindrical body 42*e* of the piston 42. In one preferred embodiment, annular region 46 may be formed by an inside surface of the valve sleeve wall 24*c* of the valve sleeve 24, and specifically, annular region 46 is axially defined between the lower pressure surface 42*g* of the flange 42*f* of the piston 42, and an inside shoulder 24*k* formed in the valve sleeve wall 24*c* of the valve sleeve 24 at the end 24*a* thereof. In another embodiment, annular region 46 may be formed by an inside surface of plug 18 such that piston 42 simply abuts a shoulder 24*k* of valve sleeve 24. Bores 42*h* permit flange 42*f* to slide within region 46 without impedance by fluid disposed in the interior of valve sleeve 24. In any event, piston spring 44 is disposed within the annular region 46 so that the cylindrical body 24*e* extends through the piston spring 44 and the coils of the piston spring 44 extend circumferentially about the cylindrical body 24*e*. Piston spring 44 may be a coil spring. The piston 42 is biased upwards by the piston spring 44. In several exemplary embodiments, instead of, or in addition to, the piston spring 44, one or more other biasing mechanisms may be disposed in the annular region 46 to thereby bias the piston 42 upwards. As shown in FIG. 4B, the valve sleeve wall 24*c*, and thus the valve sleeve 24, is characterized by an outer diameter, and the cylindrical body 42*e* of the piston 42 is characterized by an outer diameter, which is smaller than the outer diameter of the valve sleeve 24.

As shown in FIG. 4A, a ball seat 48 is disposed within the plug 18. A ball 50 is disposed within the plug 18 and between the ball seat 48 and the piston pressure surface 42*d*. Since the piston 42 is biased upwards by the piston spring 44, the piston spring 44 is thus disposed to urge the ball 50 into contact with the ball seat 48. In an exemplary embodiment, the ball seat 48 includes a ring with a bore therethrough and edges chamfered or otherwise shaped to mate with the profile of the ball 50. In an exemplary embodiment, a snap ring may be used to secure the ball seat 48 in place within the plug 18.

In an exemplary embodiment, as illustrated in FIGS. 4A, 4B, 5 and 6 with continuing reference to FIGS. 1, 2 and 3, the tubular wall 18*a* of the plug 18 further includes an upper end portion 18*ab* extending upward from the flanged portion 18*aa*, a neck portion 18*ac* extending downward from the flanged portion 18*aa*, and a body portion 18*ad* extending downward from the neck portion 18*ac*. The plurality of housing outlet flow ports 19 is defined in the body portion 18*ad* of the tubular wall 18*a* of the plug 18. A piston bore 18*c* is formed in plug 18 and thus through at least the upper end portion 18*ab*, the flanged portion 18*aa*, and the neck portion 18*ac*. Piston bore 18*c* is disposed for receipt of a portion of cylindrical body 42*e*, which is slidingly disposed therein. An axially-extending region 18*d*, which may be part of the piston bore 18*c*, is formed in the body portion 18*ad*, and defines an upper surface 18*e* and an upper internal shoulder 18*f*. A lower end 18*g* of the plug 18 engages the lock nut 22.

Figure 6:
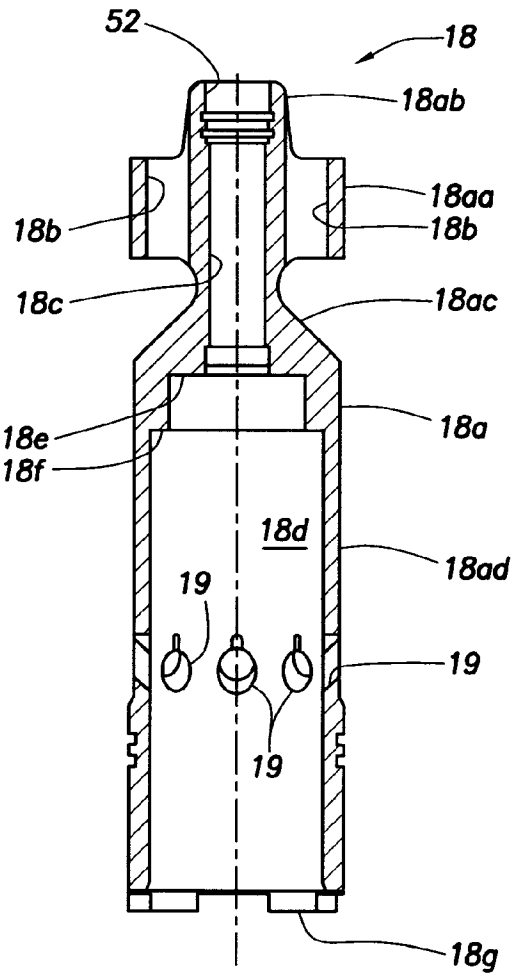
FIG. 6 illustrates a cross-sectional view of the plug of FIG. 5, according to an exemplary embodiment.
Figure 5:
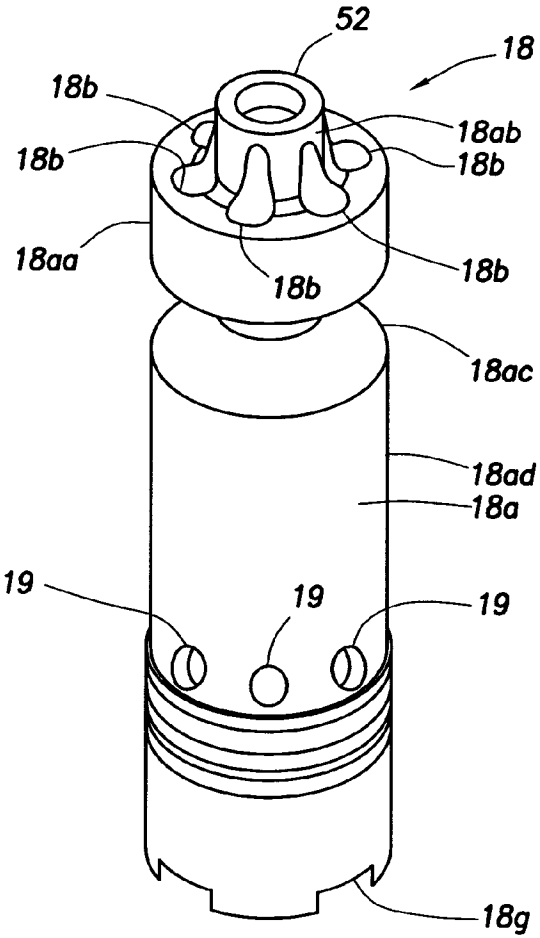
FIG. 5 illustrates a perspective view of the plug of FIG. 1, according to an exemplary embodiment.

As shown in FIGS. 4A, 5 and 6, a piston pressure port or vent 52 is defined at the upper end portion 18*ab* of the plug 18. The piston pressure port 52 is in fluid communication with the flow path 16 and is configured to allow a fluid pressure internal to the valve housing 12 and thus the valve 10 to act upon the piston pressure surface 42*d*, under conditions to be described below. The piston pressure port 52 is in fluid communication with the piston flow passage 42*c*. The ball seat 48 and the ball 50 are disposed between the piston pressure port 52 and the piston pressure surface 42*d*, with the ball seat 48 being disposed between the piston pressure port 52 and the ball 50, and the ball 50 being disposed between the ball seat 48 and the piston pressure port 52.

Figure 7:
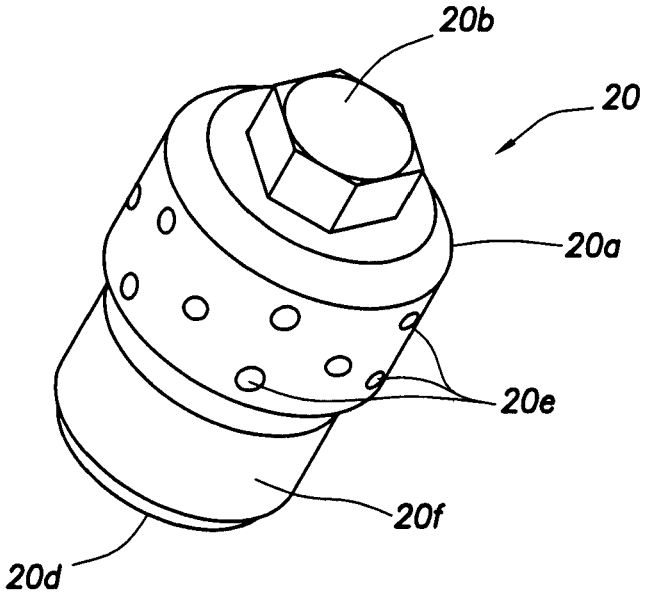
FIG. 7 illustrates a perspective view of the lockdown nut of FIG. 1, according to an exemplary embodiment.
Figure 8:
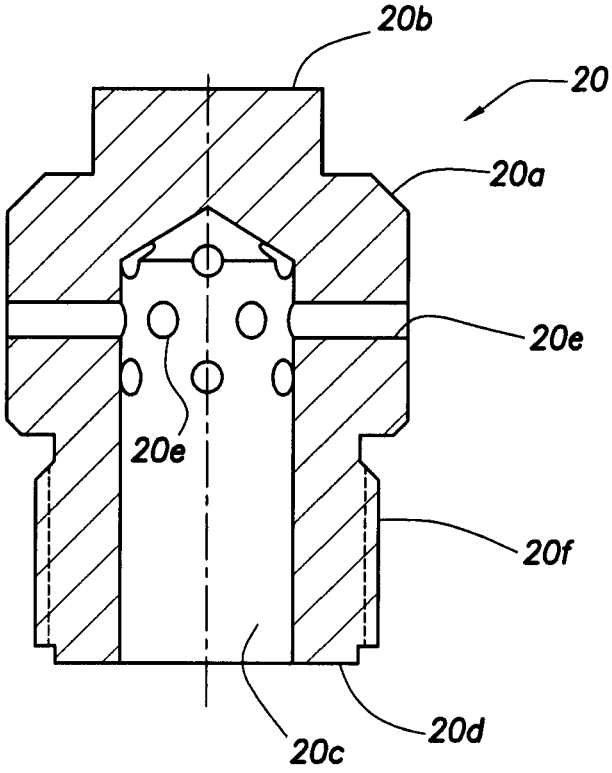
FIG. 8 illustrates a cross-sectional view of the lockdown nut of FIG. 7, according to an exemplary embodiment.

In an exemplary embodiment, as illustrated in FIGS. 7 and 8 with continuing reference to FIGS. 1, 2, 3, 4A, 4B, 5 and 6, the lockdown nut 20 includes a body 20*a* having an upper end 20*b*, an internal bore 20*c* formed in the body 20*a*, and a lower end 20*d* open to the internal bore 20*c*. The lockdown nut 20 further includes a plurality of apertures 20*e* adjacent the upper end 20*b* and in fluid communication with the internal bore 20*c*. An external threaded connection 20*f* is adjacent the lower end 20*d*. As shown in FIG. 4A, the lockdown nut 20 is disposed adjacent the piston pressure port 52 and secures the ball seat 48. Apertures 20*e* permit fluid flow from the flow path 16 into piston flow passage 42*c*.

In an exemplary embodiment, in order to resist the high pressure and flow rates that can cause wash out of sleeve flow ports 24*e*, part or all of the piston 42 is formed of a material, such as tungsten carbide, that is harder than, i.e., has a Rockwell hardness factor that is higher than, the material used to fabricate the remainder of the valve 10 (usually steel). In an exemplary embodiment, the valve housing 12 or the valve sleeve 24 is manufactured of a material having a Rockwell hardness and the piston 42 is manufactured of another material having a Rockwell hardness higher than the Rockwell hardness of the material used to manufacture the valve housing 12 or the valve sleeve 24. In an exemplary embodiment, the valve housing 12 and the valve sleeve 24 are manufactured of steel and the piston 42 is manufactured of tungsten carbide.

In operation, in an exemplary embodiment, with continuing reference to FIGS. 1, 2, 3, 4A, 4B, 5, 6, 7 and 8, the valve 10 is part of a downhole tubular, tubular string or casing, or drill string. A threaded end of a tubular support member (not shown) that defines an internal passage may be connected to the internal threaded connection 12*d* of the valve housing 12 so that the internal passage of the tubular support member is in fluid communication with the flow path 16. Similarly, a threaded end of another tubular member (not shown) that defines an internal passage may be connected to the external threaded connection 30*d* of the sub 30 so that the internal passage of the other tubular member is in fluid communication with the flow path 16. The valve 10 operates to control flow in the downhole tubular or drill string of which the valve 10 is a part, and can prevent u-tubing in the downhole tubular or drill string.

More particularly, the drill string of which the valve 10 is a part is positioned within a preexisting structure such as, for example, a wellbore that traverses one or more subterranean formations, thereby defining an annular region between the inside wall of the wellbore and the outside surface of the drill string. At this time, the valve 10 and thus the valve sleeve 24 may be in a closed position as shown in FIGS. 1, 4A and 4B.

When the valve 10 and thus the valve sleeve 24 are in the closed position as shown in FIGS. 1, 4A and 4B, the sleeve spring 34 biases the valve sleeve 24 upwards by exertion of a biasing force on the valve sleeve 24 so that the sleeve flow ports 24*e* are axially offset from the housing outlet flow ports 19. As a result, in the closed position, the valve sleeve wall 24*c* covers the housing outlet flow ports 19 and thus substantially impedes any fluid flow from the housing outlet flow ports 19 to the corresponding sleeve flow ports 24*e*. As another result, in the closed position, the upper end 24*a* of the valve sleeve 24 contacts or is at least proximate the internal shoulder 18*f* of the plug 18. Moreover, in the closed position, the piston spring 44 biases the piston 42 upwards. As a result, in the closed position, the ball 50 is seated against the ball seat 48. As another result, in the closed position, the flange 42*f* of the piston 42 is at least proximate the upper surface 18*e* of the plug 18, as shown in FIG. 4A.

In an exemplary embodiment, during or after the positioning of the drill string of which the valve 10 is a part within the wellbore, fluid flow through the valve 10 is restricted by placing the valve 10 and thus the valve sleeve 24 in the closed position described above, that is, closing the valve 10, when a difference between a fluid pressure on the upper and lower pressure surfaces is below a threshold value. This difference in pressure causes the valve sleeve 24 to remain in the closed position, thereby substantially impeding any fluid flow from the housing outlet flow ports 19 to the corresponding sleeve flow ports 24*e*, and vice versa. And this difference in pressure causes the piston 42 to remain upwardly biases, thereby urging the ball 50 upwards to seat the ball 50 against the ball seat 48 and substantially impeding any fluid flow past the ball 50.

In an exemplary embodiment, during or after the positioning of the drill string of which the valve 10 is a part within the wellbore, fluid flow through the valve 10 is permitted by opening the valve 10, that is, placing the valve 10 and thus the valve sleeve 24 in an open position from the above-described closed position, when a difference between the fluid pressure between the upper and lower pressure surfaces is above a threshold value. To so open the valve 10, drilling fluid is introduced into the valve 10, with the drilling fluid initially flowing downward past the upper end 12*a* of the valve housing 12. As a result of introducing drilling fluid into the valve 10, a pressure applied to the piston pressure surface 42*d* is induced, thereby causing the piston 42 to urge the valve sleeve 24 from the closed position.

As the pressure applied to the piston pressure surface 42*d* increases, the ball 50 is urged out of the ball seat 48. In particular, the ball 50 pushes downward against the piston pressure surface 42*d*, which causes the piston 42 to overcome the biasing force exerted by the piston spring 44, thereby urging the piston 42 downward. In an exemplary embodiment, a relatively low pressure can be used to urge the ball 50 out of the ball seat 48 because the ball 50 has a comparatively small surface area and there is little friction on the ball 50. Via the piston pressure port 52, a portion of the drilling fluid is directed through the piston 42 and into the sleeve interior 24*d* of the valve sleeve 24, thereby establishing an initial flow through the valve 10. In particular, the portion of the drilling fluid flows through the apertures 20*e* of the lockdown nut 20, through the bore 20*c*, through the piston pressure port 52, past the ball seat 48 and the ball 50, through the flow ports 42*i* of the piston 42, through the flow passage 42*c* of the piston 42, and into the sleeve interior 24*d*. Thus, initially, drilling fluid flow through the valve sleeve 24 occurs past the ball 50 and through the piston 42. The flow of the drilling fluid through the apertures 20*e* filters the drilling fluid before the drilling fluid flows past the ball seat 48, blocking any relatively large particles from flowing into or past the ball seat 48.

Another portion of the drilling fluid flows through the upper pressure fluid ports 36 from the flow path 16, entering the annular region 38 and contacting upper pressure surface 24*h* of the valve sleeve 24. As a result, a downwardly-directed fluid pressure is applied on the upper pressure surface 24*h* of the valve sleeve 24.

Figure 9:
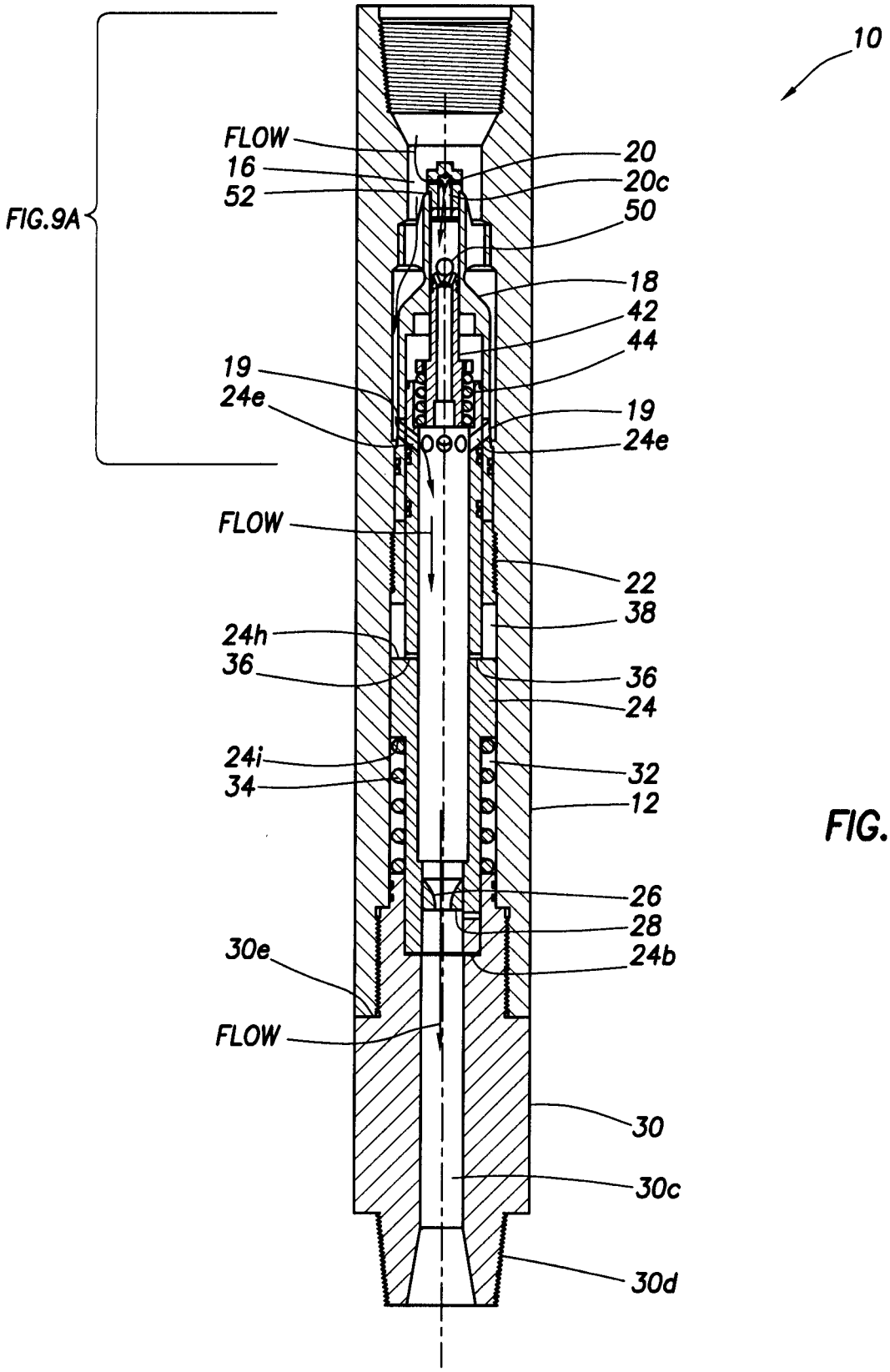
FIG. 9 illustrates a view similar to that of FIG. 1, but depicts the drill string flow control valve of FIG. 1 in an open position, according to an exemplary embodiment.
Figure 9A:
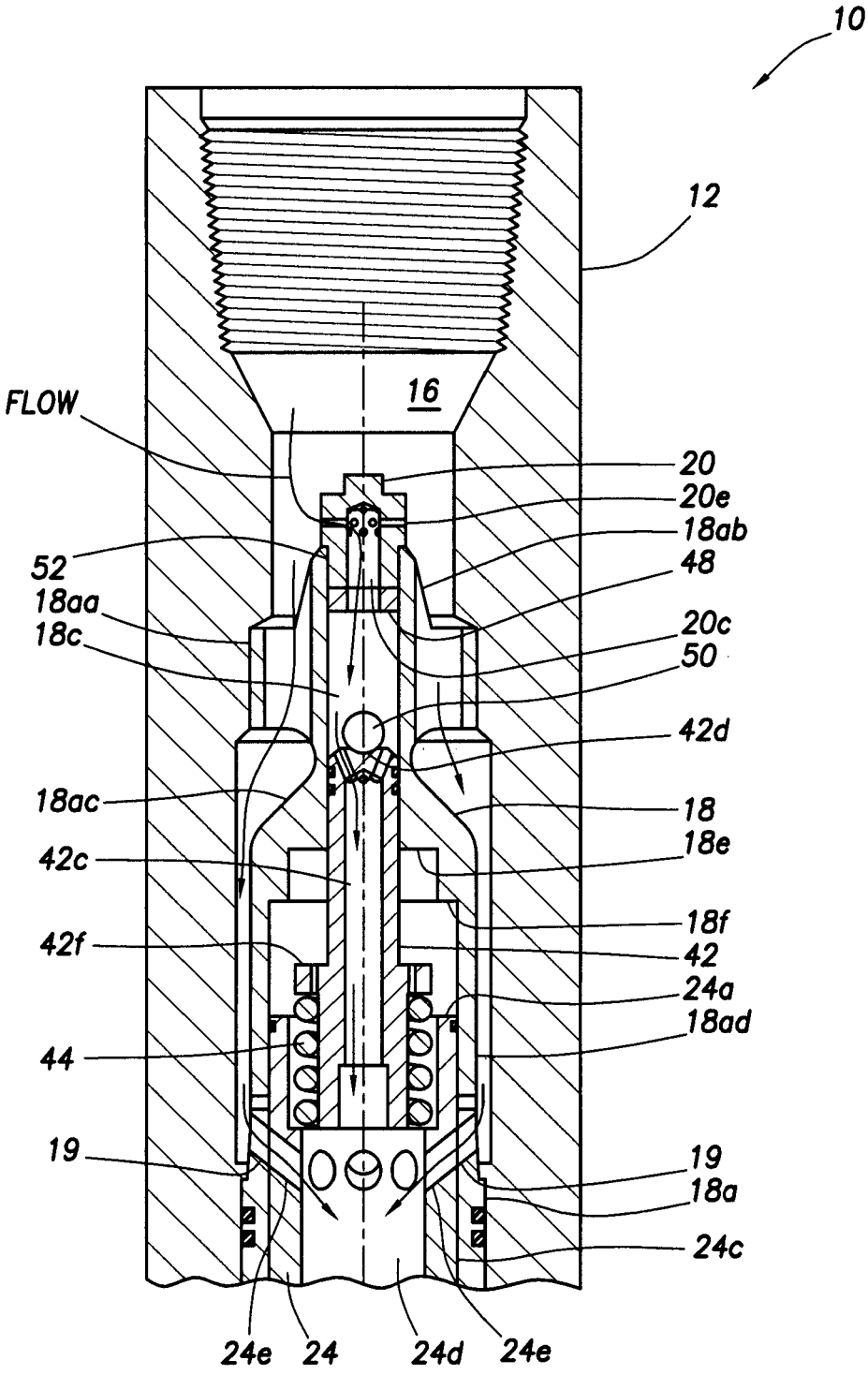
FIG. 9A illustrates an enlarged view of a portion of FIG. 9, according to an exemplary embodiment.

In an exemplary embodiment, as illustrated in FIGS. 9 and 9A with continuing reference to FIGS. 1, 2, 3, 4A, 4B, 5, 6, 7 and 8, once fluid flow has been initiated, the fluid pressure on the valve sleeve 24 is increased so as to cause the valve sleeve 24 to axially move against the biasing direction of the sleeve spring 34, thereby increasing fluid flow through the valve sleeve 24. In particular, as the downwardly-directed fluid pressure applied on the upper pressure surface 24*h* increases, the valve sleeve 24 moves axially downward, overcoming the biasing force exerted by the sleeve spring 34. As the valve sleeve 24 continues to crack open, at least respective portions of the sleeve flow ports 24*e* increasingly overlap with respective portions of the housing outlet flow ports 19 and thus flow through the partially open flow ports 19 and 24*e* begins. In particular, as respective portions of the sleeve flow ports 24*e* increasingly overlap with respective portions of the housing outlet flow ports 19, drilling fluid (off which the drilling fluid flowing through the piston 42 is split) flows along the primary portion of flow path 16, that is, axially downward through the flow bores 18*b*, between the outside surface of the neck portion 18*ac* of the plug 18 and the inside surface of the housing wall 12*c* of the valve housing 12, between the outside surface of the body portion 18*ad* of the plug 18 and the inside surface of the housing wall 12*c* of the valve housing 12, through the partially open flow ports 19 and 24*e*, through the sleeve interior 24*d*, through the flow restriction 26, and through the interior 30*c* of the sub 30. The foregoing permits a greater degree of control of fluid flow through the flow ports 19 and 24*e* and minimizes pressure drop. Moreover, by splitting the fluid flow so that a portion of the fluid flows through the piston 42 and another portion flows through the ports 19 and 24*e*, the velocity of the fluid flowing through the partially open ports 19 and 24*e* is reduced, thereby reducing the risk that the partially open ports 19 and 24*e* will experience potential washout, i.e., the corroding or washing away of the material (such as steel) from which the housing 12, the plug 18 and the sleeve 24 are typically fabricated. In accordance with the foregoing, in an exemplary embodiment, the flow rate of the drilling fluid flow through the piston 42 may be slowly increased to create a sufficient pressure differential to open the ports 19 and 24*e*.

As shown in FIGS. 9 and 9A, the valve sleeve 24 continues to axially move against the biasing direction of the sleeve spring 34, thereby increasing fluid flow through the valve sleeve 24, until the end 24*b* of the valve sleeve 24 contacts or, is at least proximate, the internal shoulder 30*e* of the sub 30. At this point, the valve 10 and thus the valve sleeve 24 are in the open position in which the sleeve flow ports 24*e* and the corresponding housing outlet flow ports 19 are in substantial alignment, as shown in FIGS. 9 and 9A.

In an exemplary embodiment, once fluid flow has been initiated, a fluid pressure, derived downstream of the fluid pressure applied to the upper pressure surface 24*h*, is applied to the valve sleeve 24 to generate a force to urge the valve sleeve 24 upward. In particular, drilling fluid flows through the lower pressure fluid port 40, entering the annular region 32 and contacting lower pressure surface 24*i* of the valve sleeve 24. As a result, an upwardly-directed fluid pressure is applied on the lower pressure surface 24*i* of the valve sleeve 24. When the valve 10 and thus the valve sleeve 24 are in the open position, the drilling fluid flow through the valve 10 is maintained so that the force urging the valve sleeve 24 downward is greater than the upwardly-directed biasing force exerted by the sleeve spring 34 plus the upwardly-directed force exerted by the fluid pressure against the lower pressure surface 24*i*.

In an exemplary embodiment, whether or not flow control valve 10 includes a piston 42 as described herein, the upper pressure fluid ports 36 are positioned upstream of flow restriction 26 and the lower pressure port 40 is positioned downstream of flow restriction 26. As a result, during the flow of the drilling fluid along the flow path 16, the pressure differential across the flow restriction 26 can be utilized to facilitate control of valve sleeve 24. In several exemplary embodiments, the dimensions of the flow restriction 26 can be altered to adjust pressure drops. If the flow restriction 26 includes a ring with a bore formed therethrough, the dimensions of the bore can be altered to adjust pressure drops, and the ring may be interchangeable with others and secured in place with the snap ring 28 or similar fastener.

In an exemplary embodiment, the valve 10 and thus the valve sleeve 24 may be placed back into the closed position shown in FIGS. 1, 4A and 4B from the open position shown in FIGS. 9 and 9A by decreasing the downwardly-directed fluid flow through the valve 10 so as to allow the biasing force exerted by the sleeve spring 34 to shift the valve sleeve 24 upwards, thereby urging the valve sleeve 24 and thus the valve 10 into the closed position described above.

Figure 10:
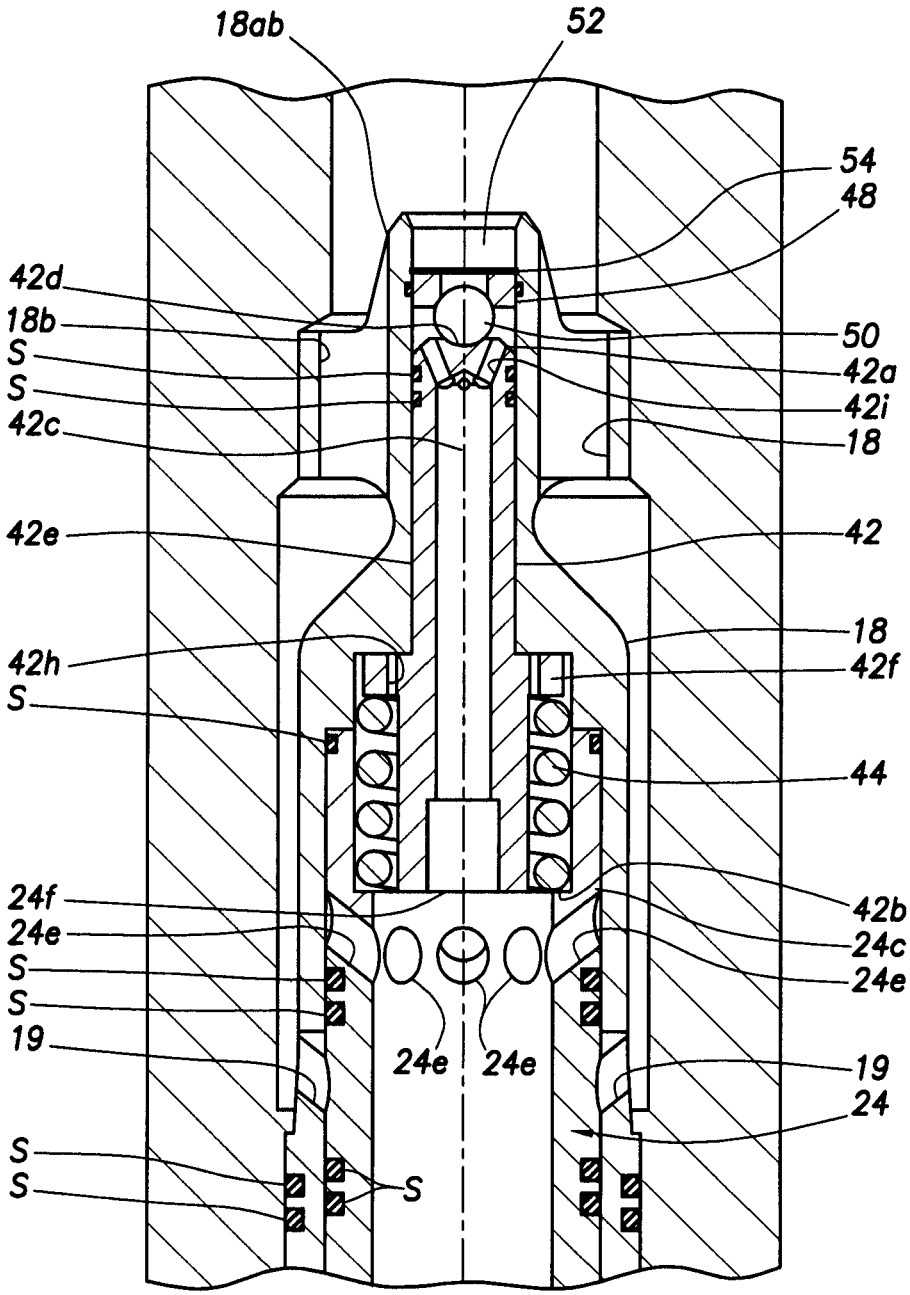
FIG. 10 illustrates a cross-sectional view of a portion of a drill string flow control valve, according to another exemplary embodiment.

In an exemplary embodiment, as illustrated in FIG. 10 with continuing reference to FIGS. 1, 2, 3, 4A, 4B, 5, 6, 7, 8, 9 and 9A, the lockdown nut 20 is omitted from the valve 10. Additionally, a lock ring 54 is disposed in the piston pressure port 52, and is connected to the plug 18. The lock ring 54 secures the ball seat 48 in place. The operation of the valve 10 without the lockdown nut 20 but with the lock ring 54 is substantially identical to the above-described operation of the valve 10 with the lockdown nut 20, except that, due to the omission of the lockdown nut 20, the drilling fluid is not filtered by the lockdown nut 20 before flowing past the ball seat 48.

In several exemplary embodiments, and as illustrated in at least FIGS. 1, 2, 4A, 4B, 5, 6, 9, 9A and 10, optional seals are provided at the indicated locations to prevent or at least resist unwanted leakage of fluid and to prevent or at least resist unwanted communication of fluid pressures to undesired sites. In several exemplary embodiments, such optional seals may include annular grooves formed in outside surfaces of tubular walls and corresponding annular sealing elements disposed in the annular grooves, with the sealing elements sealingly engaging inside surfaces of tubular walls within which the tubular walls having the annular grooves respectively extend. Examples of such optional seals are referred to by the reference S in FIG. 10.

Although drill pipe threads have been depicted herein in several embodiments, it is explicitly recognized that the drill string flow control valves, the joints of drill pipe, and other drill string components herein may be attached to one another by any suitable means known in the art including, but not limited to, drill pipe threads, ACME threads, high-torque shoulder-to-shoulder threads, o-ring seals, welding, or any combination thereof.

While the foregoing has been described in relation to a drill string and is particularly desirable for addressing u-tubing concerns, those skilled in the art with the benefit of this disclosure will appreciate that the drill string flow control valves of this disclosure can be used in other fluid flow applications without limiting the foregoing disclosure.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present invention. Also, the terms in the claims have their plain, ordinary meaning unless otherwise explicitly and clearly defined by the patentee.

What is claimed is:

1. A drill string flow control valve comprising:

a valve housing characterized by a wall defining a valve interior, wherein the valve housing has an internal housing flow path formed therein with a housing outlet flow port disposed along said internal housing flow path;

a valve sleeve disposed at least partially in the interior of the valve housing, the valve sleeve characterized by a first end and a second end and a wall defining a sleeve interior, a first sleeve flow port defined within the valve sleeve wall, and a second sleeve flow port defined within the valve sleeve wall adjacent said first end, wherein the valve sleeve is axially movable within the valve housing between a closed position and an open position, such that the valve sleeve wall substantially impedes fluid flow from the housing outlet flow port to the first sleeve flow port when the valve sleeve is in the closed position and wherein the first sleeve flow port and the housing outlet flow port are in substantial alignment when in the open position;

wherein the valve sleeve has an upper pressure surface defined thereon so as to provide a first surface area upon which a first fluid pressure from the internal housing flow path may act to provide a downward force on the valve sleeve and wherein the valve sleeve has a lower pressure surface defined thereon so as to provide a second surface area upon which a second fluid pressure may act to provide an upward force on the valve sleeve;

a spring wherein the spring biases the valve sleeve to the closed position by exertion of a biasing force on the valve sleeve;

an upper pressure port in fluid communication with said internal housing flow path, said upper pressure port disposed to allow the first fluid pressure to act upon the upper pressure surface;

a lower pressure port that allows the second fluid pressure to act upon the lower pressure surface;

a piston having a first end and a second end and axially movable within the valve housing, said piston further characterized by a flow passage therethrough, wherein the second end of the piston is adjacent one end of the valve sleeve to permit fluid communication between said piston flow passage and said second sleeve flow port and wherein the piston has a piston pressure surface characterized by a piston surface area; and a piston pressure port in fluid communication with the internal housing flow path that allows a fluid pressure internal to the valve to act upon the piston pressure surface, said piston pressure port in fluid communication with said piston flow passage.

2. The drill string flow control valve of claim 1 wherein the first sleeve flow port is disposed in said valve sleeve wall to be substantially radially formed therein and wherein said second sleeve flow port is disposed in said valve sleeve wall to be substantially axially formed therein.

3. The drill string flow control valve of claim 1, wherein the piston surface area is defined at the first end of the piston and is smaller than the first surface area of the sleeve.

4. The drill string flow control valve of claim 1, wherein the sleeve is characterized by an outer diameter and the piston body is characterized by an outer diameter, wherein the piston body outer diameter is smaller than the outer diameter of the sleeve.

5. The drill string flow control valve of claim 1 wherein the upper pressure port is formed in the valve sleeve wall.

6. The drill string flow control valve of claim 1 further comprising a ball and a ball seat disposed between said piston pressure port and said piston pressure surface.

7. The drill string flow control valve of claim 6 further comprising a piston spring disposed to urge said ball into contact with said ball seat.

8. The drill string flow control valve of claim 7 further comprising a lockdown nut disposed in said piston pressure port and securing said ball seat.

9. The drill string flow control valve of claim 8 wherein said lockdown nut comprises a body having a first end, an internal bore and a second end open to said internal bore, said body further comprising a plurality of apertures adjacent said first end and in fluid communication with said internal bore.

10. The drill string flow control valve of claim 6 wherein the ball is disposed to engage the piston pressure surface.

11. The drill string flow control valve of claim 1 wherein said valve housing is manufactured of a first material having a first Rockwell hardness and said piston is manufactured of a second material having a second Rockwell hardness higher than said first Rockwell hardness.

12. The drill string flow control valve of claim 11 wherein said valve housing is manufactured of steel and said piston is manufactured of tungsten carbide.

13. The drill string flow control valve of claim 1, wherein said lower pressure port is disposed in the valve sleeve wall.

14. A drill string flow control valve comprising:

a valve housing, wherein the valve housing is characterized by a cylindrical wall extending from a first end to a second end and defining a valve interior, wherein the valve housing has an internal housing flow path channel formed between said first and second ends with a housing outlet flow port disposed along said flow path channel;

a valve sleeve disposed at least partially in the valve housing, the valve sleeve characterized by a valve sleeve wall defining a valve sleeve interior, said valve sleeve having a first sleeve flow port defined within said wall and a second sleeve flow port defined within said wall, wherein the valve sleeve is axially movable within the valve housing between a closed position and an open position, such that fluid flow between said housing outlet flow port and said first sleeve flow port is substantially impeded when the valve sleeve is in the closed position and wherein the first sleeve flow port and the housing outlet flow port are substantially aligned when in the open position;

wherein the valve sleeve has a first pressure surface defined thereon so as to provide a first surface area upon which a first fluid pressure from the housing flow path channel may act to provide a downward force on the valve sleeve, and wherein the valve sleeve has a second pressure surface defined thereon so as to provide a second surface area upon which a second fluid pressure may act to provide an upward force on the valve sleeve;

a biasing mechanism wherein the biasing mechanism biases the valve sleeve to the closed position;

a first pressure channel that allows the first fluid pressure to act upon the first pressure surface;

a second pressure channel that allows the second fluid pressure to act upon the second pressure surface;

an elongated piston having a first end, an internal bore and a second end open to said internal bore, said piston axially movable within the valve housing, wherein said second open end is in fluid communication with said second sleeve flow port; and a piston pressure port in fluid communication with the internal housing flow path, said piston pressure port in fluid communication with said internal bore of said piston.

15. The drill string flow control valve of claim 14 further comprising a ball and ball seat disposed between said piston pressure port and said piston.

16. The drill string flow control valve of claim 15 further comprising a piston spring disposed to urge said ball into contact with said ball seat.

17. The drill string flow control valve of claim 14, wherein the valve sleeve further comprises a flow restriction in the valve sleeve interior, wherein said second pressure channel is disposed in the wall of the valve sleeve below the flow restriction and the first pressure channel is disposed in the wall of the valve sleeve above the flow restriction.

18. The drill string flow control valve of claim 14, wherein said second pressure channel is disposed in the valve sleeve wall.

19. A method for controlling flow in a downhole tubular, the method comprising:

restricting flow through the downhole tubular by closing a flow stop valve when a difference between a first fluid pressure and a second fluid pressure along a primary flow path within the downhole tubular is below a threshold value; and permitting flow along the primary flow path of the downhole tubular by opening the flow stop valve when a difference between the first fluid pressure and the second fluid pressure is above a threshold value, wherein said flow stop valve is opened by:

introducing drilling fluid into the valve to induce a pressure applied to the pressure surface of a piston, thereby causing said piston to urge a valve sleeve from a closed position;

directing a portion of said drilling fluid through said piston and into the interior of said valve sleeve to establish initial flow through said valve;

directing another portion of said drilling fluid against said valve sleeve to apply a fluid pressure on the valve sleeve; and increasing the fluid pressure upon the valve sleeve so as to cause the valve sleeve to axially move against the biasing direction of a spring, thereby increasing fluid flow through said valve sleeve.

20. The method of claim 19 wherein directing the other portion of said drilling fluid against said valve sleeve to apply the fluid pressure on said valve sleeve comprises directing the other portion of said drilling fluid through a pressure fluid port formed in said valve sleeve; and wherein the method further comprises disposing a flow restriction within said valve sleeve so that said pressure fluid port is positioned between said piston and said flow restriction.

21. The method of claim 19 wherein said flow stop valve is closed by:

permitting the spring to bias the valve sleeve so as to cause the valve sleeve to axially move in the biasing direction of the spring to the closed position; and permitting another spring to bias the piston so as to cause the piston to axially move in the biasing direction of the other spring.

22. The method of claim 21 further comprising:

disposing a ball seat in the flow stop valve so that at least a portion of the piston is positioned between the ball seat and the valve sleeve; and disposing a ball in the flow stop valve so that the ball is positioned between the ball seat and the pressure surface of the piston;

wherein the ball contacts the ball seat in response to permitting the other spring to bias the piston so as to cause the piston to axially move in the biasing direction of the other spring.

23. The method of claim 21 wherein said valve sleeve is manufactured of a first material having a first Rockwell hardness and said piston is manufactured of a second material having a second Rockwell hardness higher than said first Rockwell hardness.

24. A method for controlling flow in a downhole tubular, the method comprising:

providing a valve housing, wherein the valve housing is characterized by a tubular wall extending from a first end to a second end and defining a valve interior, wherein the valve housing has an internal housing flow path formed between said first and second ends with a housing outlet flow port disposed along said internal flow path;

providing a valve sleeve disposed at least partially in the valve housing, the valve sleeve having at least two pressure surfaces and axially movable within the valve housing between a closed position and an open position, providing a piston having a flow passage therethrough within the valve housing and bearing against the valve sleeve;

biasing the valve sleeve under a biasing force in a first direction against the piston so as to close the valve;

introducing drilling fluid into the valve housing to induce a first fluid pressure therein;

applying said first fluid pressure to the piston pressure surface, thereby causing said piston to urge the valve sleeve in a second direction opposite the first direction;

directing a portion of the drilling fluid to flow through said piston flow passage and into the interior of said valve sleeve to initiate flow;

applying fluid pressure from within the valve housing to a first surface of the valve sleeve to generate a first force to urge the valve sleeve in the second direction;

applying a second fluid pressure derived from downstream of said first fluid pressure to a second surface of the valve sleeve to generate a second force to urge the valve sleeve in the first direction;

maintaining a drilling fluid flow through the valve sleeve so that the first force is greater than the biasing spring force plus the second force; and decreasing the fluid flow through the valve sleeve so as to allow the biasing force to shift the valve sleeve in the first direction, thereby urging the valve into a closed position.

25. The method of claim 24 wherein applying fluid pressure from within the valve housing to the first surface of the valve sleeve to generate the first force to urge the valve sleeve in the second direction comprises directing another portion of the drilling fluid through a pressure port formed in the valve sleeve; and wherein the method further comprises disposing a flow restriction within the valve sleeve so that the pressure port is positioned between the piston and the flow restriction.

26. The method of claim 24 further comprising disposing a ball seat between the first end of the valve housing and said piston pressure surface; and disposing a ball between the ball seat and said piston pressure surface.

27. The method of claim 26 further comprising disposing a piston spring to urge said ball into contact with said ball seat.

28. The method of claim 24 wherein said valve housing is manufactured of a first material having a first Rockwell hardness and said piston is manufactured of a second material having a second Rockwell hardness higher than said first Rockwell hardness.

29. A drill string flow control valve system comprising:

a valve housing, wherein the valve housing is characterized by a tubular wall extending from a first end to a second end and defining a valve interior, wherein the valve housing has an internal housing flow path formed between said first and second ends with a housing outlet flow port disposed along said internal flow path;

a valve sleeve disposed at least partially in the valve housing, the valve sleeve having a first end and a second end and characterized by a valve sleeve wall extending between said first and second ends to define a valve sleeve interior, said valve sleeve having a first flow port disposed in said valve sleeve wall and a second flow port at said first end, wherein the valve sleeve is axially movable within the valve housing between a closed position and an open position, such that fluid flow between said housing outlet flow port and said first flow port is substantially impeded when the valve sleeve is in the closed position and wherein the first flow port and the housing outlet flow port are substantially aligned when in the open position;

wherein the valve sleeve has an upper pressure surface defined thereon so as to provide a first surface area upon which a first fluid pressure from the internal housing flow path may act to provide a downward force on the valve sleeve, and wherein the valve sleeve has a lower pressure surface defined thereon so as to provide a second surface area upon which a second fluid pressure may act to provide an upward force on the valve sleeve;

a spring, wherein the spring biases the valve sleeve to the closed position by exertion of a biasing force on the valve sleeve;

an upper pressure port that allows the first fluid pressure to act upon the first pressure surface;

a lower pressure port that allows the second fluid pressure to act upon the second pressure surface;

wherein the valve sleeve further comprises a flow restriction in the valve sleeve interior, wherein said lower pressure port is disposed in the wall of the valve sleeve below the flow restriction and the upper pressure port is disposed in the wall of the valve sleeve above the flow restriction.

30. The drill string flow control valve system of claim 29, further comprising an elongated piston having a first end, an internal bore and a second end open to said internal bore, said piston axially movable within the valve housing, wherein the second end of the piston is adjacent an end of the valve sleeve and in fluid communication with the second flow port of said valve sleeve, and wherein the first end of the piston has a piston pressure surface characterized by a piston surface area; and a piston pressure port in fluid communication with said internal housing flow path that allows a fluid pressure internal to the valve to act upon the piston pressure surface, said piston pressure port in fluid communication with said piston internal bore.

31. The drill string flow control valve system of claim 30, further comprising a plug disposed in the first end of said valve housing, said plug having a piston cylinder defined therein and wherein said piston pressure port is formed in said plug and in communication with said piston cylinder.

32. The drill string flow control valve system of claim 31, wherein at least a portion of said internal housing flow path is formed between said plug and said valve housing tubular wall.

33. The drill string flow control valve system of claim 30 further comprising a ball adjacent said piston pressure surface and ball seat disposed along said piston pressure port and a spring disposed to urge said ball into contact with said ball seat.

34. The drill string flow control valve system of claim 30, wherein said elongated piston is at least partially disposed in said piston cylinder of said plug.

35. The drill string flow control valve system of claim 29, wherein said lower pressure port is disposed in the valve sleeve wall.

36. The drill string flow control valve system of claim 29, wherein the first fluid pressure is measured from adjacent the first end of the valve housing and wherein the second fluid pressure is measured from adjacent the second end of the valve housing.

37. A drill string flow control valve system comprising:

a valve housing formed of a tubular member extending from a first end to a second end and characterized by an external surface, said tubular member having a first flow path internally disposed therein;

a valve sleeve slidingly mounted in the valve housing, said valve sleeve having a first end, a first flow port, a second flow port, a valve sleeve interior and a second end;

a piston having a first end, an internal piston bore and a second open end in fluid communication with said piston bore, said piston slidingly mounted in the valve housing between said first end of the tubular member and said valve sleeve, wherein the second end of the piston is disposed to urge the valve sleeve axially relative to the valve housing, wherein said second open end of said piston is in fluid communication with the second flow port of said valve sleeve;

a piston pressure port in fluid communication with said first internal housing flow path, said piston pressure port also in fluid communication with the piston bore;

a ball and ball seat disposed along said piston pressure port;

a first biasing mechanism disposed to urge said piston against said ball and to urge said ball into contact with said ball seat;

a second biasing mechanism for biasing the valve sleeve against the piston;

a first pressure port in the valve sleeve, said first pressure port in fluid communication with said internally disposed first flow path, said first pressure port in fluid communication with a first surface of the sleeve to provide a pressure acting on the first surface of the sleeve; and a second pressure port in fluid communication with a second surface of the sleeve to provide a second fluid pressure acting on the second surface of the sleeve, said second fluid pressure derived from adjacent the second end of said valve housing.

38. The drill string flow control valve system of claim 37, further comprising a plug disposed in the first end of said valve housing, said plug having a piston cylinder defined therein and said piston pressure port being formed in said plug and in communication with said piston cylinder, wherein said elongated piston is at least partially disposed in said piston cylinder of said plug.

39. The drill string flow control valve system of claim 38, wherein at least a portion of said internal housing flow path is formed between said plug and said valve housing tubular wall.

40. The drill string flow control valve system of claim 37, wherein the ball and the ball seat form a valve along said piston pressure port between said piston bore and said first flow path.

41. The drill string flow control valve system of claim 37, wherein the first pressure port is bled off of the first flow path.

42. The drill string flow control valve system of claim 37, wherein the valve sleeve further comprises a flow restriction in the sleeve interior, wherein said second pressure port is disposed in the valve sleeve below the flow restriction.

43. A drill string flow stop valve comprising: a tubular housing having an external surface and a first flow path internally disposed therein and an internal flow port disposed along said flow path; a hollow tubular section slidingly mounted in the valve housing and movable between a first position and a second position thereby establishing a second flow path in the interior of the hollow tubular section, wherein the hollow tubular section substantially impedes fluid flow through the internal flow port to an interior of the hollow tubular section when the valve sleeve is in the first position and wherein fluid flow through the internal flow port to the interior of the hollow tubular section is permitted when the valve sleeve is in the second position; a biasing mechanism for biasing the hollow tubular section toward the first position; a first vent in fluid communication with the internally disposed first flow path, said first vent in fluid communication with a first pressure chamber; a second vent in fluid communication with a second pressure chamber which is separate from the first pressure chamber, said second vent in fluid communication with the second flow path; an elongated piston having a first end, an internal bore and a second end open to said internal bore, wherein said second open end is in fluid communication with the interior of said hollow tubular section; and a third vent in fluid communication with the internally disposed first flow path, said third vent in fluid communication with said internal bore of said elongated piston.

44. The drill string flow stop valve of claim 43, further comprising: a ball and ball seat disposed along said third vent to regulate flow through said third vent; a first biasing mechanism disposed to urge said piston against said ball and to urge said ball into contact with said ball seat; and a second biasing mechanism for biasing the hollow tubular section against the piston.

45. The drill string flow stop valve of claim 43, wherein said hollow tubular section further comprises a flow restriction in the interior thereof, and wherein said first vent is disposed between said piston and said flow restriction.

* * * * *